US011925878B2

(12) United States Patent
Kelly et al.

(10) Patent No.: US 11,925,878 B2
(45) Date of Patent: Mar. 12, 2024

(54) ILLUMINATING BUBBLE PRODUCING TOY WITH ATTACHABLE INFLATABLE BALLOON

(71) Applicant: LIGHTUPTOYS.COM LLC, Sellersburg, IN (US)

(72) Inventors: Joshua C. Kelly, New Albany, IN (US); Christopher D. Kelly, New Albany, IN (US); Max Armendariz Lalama, Sellersburg, IN (US)

(73) Assignee: LIGHTUPTOYS.COM LLC, Sellersburg, IN (US)

( * ) Notice: Subject to any disclaimer, the term of this patent is extended or adjusted under 35 U.S.C. 154(b) by 0 days.

(21) Appl. No.: 17/814,304

(22) Filed: Jul. 22, 2022

(65) Prior Publication Data

US 2022/0379232 A1 Dec. 1, 2022

Related U.S. Application Data

(63) Continuation-in-part of application No. 17/335,447, filed on Jun. 1, 2021.

(60) Provisional application No. 63/203,456, filed on Jul. 23, 2021.

(51) Int. Cl.
*A63H 33/28* (2006.01)
*A63H 33/22* (2006.01)

(52) U.S. Cl.
CPC ..... *A63H 33/28* (2013.01); *A63H 33/22* (2013.01)

(58) Field of Classification Search
CPC .. A63H 33/28; A63H 2027/1008–1091; A63H 27/10; A63H 5/00; A63H 33/26; A61L 9/03; A61L 9/015
USPC ..... 362/109; 345/473
See application file for complete search history.

(56) References Cited

U.S. PATENT DOCUMENTS 303,885 A * 8/1884 Ridge ..... F41J 1/01 273/365
1,566,858 A * 12/1925 Guinzburg ..... B63C 9/08 43/3
1,659,248 A * 2/1928 Eldon ..... B63C 9/24 43/3

(Continued)

FOREIGN PATENT DOCUMENTS

CN 306513740 S 5/2021
CN 213491994 U 6/2021

*Primary Examiner* — Eugene L Kim
*Assistant Examiner* — Matthew B Stanczak
(74) *Attorney, Agent, or Firm* — Scott R. Cox; Jessica C. Ronald

(57) ABSTRACT

An illuminating bubble producing toy with an attachable inflatable balloon. The toy includes a housing with two ends, wherein the housing contains the electronic components of the toy. A bubble solution reservoir is connectable to the first end of the housing and a hollow shaft is connected to the second end. The balloon attaches around the hollow shaft. A drive shaft is fixed within the hollow shaft, with one end connected to the motor and the second end containing a wiper. A nozzle is secured within the second end of the hollow shaft and the wiper rotates around the inside of the nozzle. A tubular channel has a first end submerged within the solution reservoir and a second end connected to the nozzle. A printed circuit board is secured around a base of the hollow shaft and electrically connected to the power source and various LEDs.

20 Claims, 5 Drawing Sheets

(56) References Cited

U.S. PATENT DOCUMENTS 1,801,267 A * 4/1931 Dorogi ..... B29D 22/02 446/226
2,134,063 A * 10/1938 Turchanyi ..... A63H 3/06 446/221
2,663,968 A * 12/1953 Longino ..... A63H 27/10 446/224
2,882,643 A * 4/1959 Jianas ..... A63H 33/28 446/21
2,922,252 A * 1/1960 Van Dam ..... A63H 27/10 446/221
2,977,973 A * 4/1961 Chakine ..... F16L 55/1141 116/DIG. 44
4,034,495 A * 7/1977 Lemelson ..... B32B 27/00 40/545
4,179,832 A * 12/1979 Lemelson ..... F21S 2/00 40/550
4,655,722 A * 4/1987 Baron ..... A63H 33/28 239/211
4,776,589 A * 10/1988 Yang ..... A63B 43/06 473/570
4,787,875 A * 11/1988 Baron ..... A63H 33/28 239/289
4,799,914 A * 1/1989 Hutchinson ..... A63H 27/10 244/30
4,929,215 A * 5/1990 Lovik ..... A63H 27/10 446/124
4,953,713 A * 9/1990 Yaffe ..... A47F 5/04 446/221
5,036,985 A * 8/1991 Lovik ..... A47F 7/00 211/13.1
5,045,011 A * 9/1991 Lovik ..... A63H 33/18 473/610
5,071,383 A * 12/1991 Kinoshita ..... B64C 39/024 244/30
5,102,131 A * 4/1992 Remington ..... A63B 43/06 446/438
5,102,364 A * 4/1992 Kubiatowicz ..... G09F 21/06 40/214
5,282,768 A * 2/1994 Akman ..... A63H 27/10 446/221
5,324,527 A * 6/1994 Coleman ..... A23G 3/563 426/115
5,334,072 A * 8/1994 Epstein ..... A63H 27/10 446/224
5,675,922 A * 10/1997 Skistimas ..... G09F 7/00 434/81
5,820,437 A * 10/1998 Coleman ..... A63H 5/00 426/104
D437,435 S * 2/2001 Spangler ..... D26/47
6,224,236 B1 * 5/2001 Shu ..... F21L 2/00 362/205
6,478,651 B1 * 11/2002 Weir ..... G09F 19/00 40/538
6,550,928 B1 4/2003 Lin
6,572,244 B1 * 6/2003 Clark ..... A23G 3/50 362/253
6,626,559 B1 * 9/2003 Lin ..... F21V 3/023 362/124
6,730,339 B2 * 5/2004 Chan ..... A23G 3/50 426/115
7,320,529 B2 * 1/2008 Goh ..... F21V 3/023 362/189
D622,327 S * 8/2010 Roos ..... D26/38
9,267,660 B1 2/2016 Pan
9,314,706 B1 * 4/2016 Wicken ..... A63H 27/10
D831,871 S * 10/2018 Patel ..... D26/51
10,674,588 B2 6/2020 Kelly et al.
10,738,972 B1 8/2020 Kelly et al.
11,149,932 B1 10/2021 Kelly et al.
11,274,707 B2 3/2022 Kelly et al.
11,322,056 B2 * 5/2022 Ahn ..... G09G 3/001
2003/0016529 A1 * 1/2003 Schuren ..... A23G 3/563 362/253
2004/0077264 A1 * 4/2004 Walker ..... A63H 33/26 446/175
2008/0130266 A1 6/2008 DeWitt
2010/0053944 A1 3/2010 Yao-Lin
2012/0031526 A1 * 2/2012 Grassley ..... A63H 27/10 141/10
2013/0309940 A1 * 11/2013 Miyako ..... A63H 33/26 446/485
2013/0314905 A1 * 11/2013 Yang ..... F21V 3/026 362/109
2015/0056884 A1 * 2/2015 Fogarty ..... A63H 33/28 446/15
2015/0147931 A1 * 5/2015 Wong ..... A63H 33/00 446/26
2016/0214023 A1 * 7/2016 Wicken ..... A63H 27/10
2019/0111358 A1 * 4/2019 Kelly ..... A63H 33/28
2019/0120477 A1 * 4/2019 Yan ..... F21V 31/005
2020/0054959 A1 * 2/2020 Weigl, Jr. ..... A63H 33/28
2020/0096182 A1 * 3/2020 Hetzroni ..... F21V 3/026
2020/0353374 A1 * 11/2020 Kaye ..... A63H 27/10
2021/0379503 A1 * 12/2021 Kelly ..... A63H 33/22
2022/0049842 A1 2/2022 Kelly et al.
2022/0054951 A1 * 2/2022 Bradley ..... A63H 33/28
2022/0168662 A1 * 6/2022 Kelly ..... A63H 33/28
2022/0379232 A1 * 12/2022 Kelly ..... A63H 33/28
2023/0083190 A1 * 3/2023 Chen ..... A63H 27/10 446/15

* cited by examiner

ILLUMINATING BUBBLE PRODUCING TOY WITH ATTACHABLE INFLATABLE BALLOON

CROSS-REFERENCES

This application is a continuation-in-part of and claims the benefit of U.S. application Ser. No. 17/335,447 filed on Jun. 1, 2021 and further claims priority from provisional application Ser. No. 63/203,456, filed Jul. 23, 2021. All publications, patents and patent applications referred to herein are incorporated by reference in their entirety.

FIELD OF INVENTION

The invention relates to the technical field of electronic bubble producing toys. More particularly, to electronic bubble producing toys with inflatable balloons attached thereto, wherein the toys include various light emitting diodes ("LEDs") that reflect through a prismatic reflector, which reflector splits the light into a unique pattern when reflecting into the balloon.

BACKGROUND OF THE INVENTION

Electronic bubble producing toys exist, such as a bubble wand or a bubble sword. However, these existing toys do not include an inflatable balloon that attaches thereto, for example around a shaft of the wand or sword. Moreover, they do not include an inflatable balloon that is easily interchangeable with other balloons.

Moreover, although these existing toys may include LEDs, they do not include a prismatic reflector that splits light from the LEDs upwardly into the balloon in a unique pattern.

SUMMARY OF THE INVENTION

An illuminating bubble producing toy with an attachable inflatable balloon including a housing with two ends, wherein the housing contains a motor, a pump, and an air producing device attached to an air duct, which are all electrically connected to a power source. A bubble producing solution reservoir is connectable to the first end of said housing and a hollow shaft is connected to the second end of the housing. A drive shaft is fixed within the hollow shaft, with one end connected to the motor and the second end containing a wiper. A nozzle is secured within the second end of the hollow shaft and the wiper rotates around the inside of the nozzle. A channel with a tubular structure includes two ends with a first end submerged within the solution reservoir and a second end is connected to the nozzle. A printed circuit board is secured around a base of the hollow shaft and electrically connected to the power source and various LEDs, which are secured thereto. The inflatable balloon attaches around the shaft. The LEDs reflect through a prismatic reflector secured around the LEDs to create a unique pattern within the balloon and the shaft.

DETAILED DESCRIPTION

Figure 1:
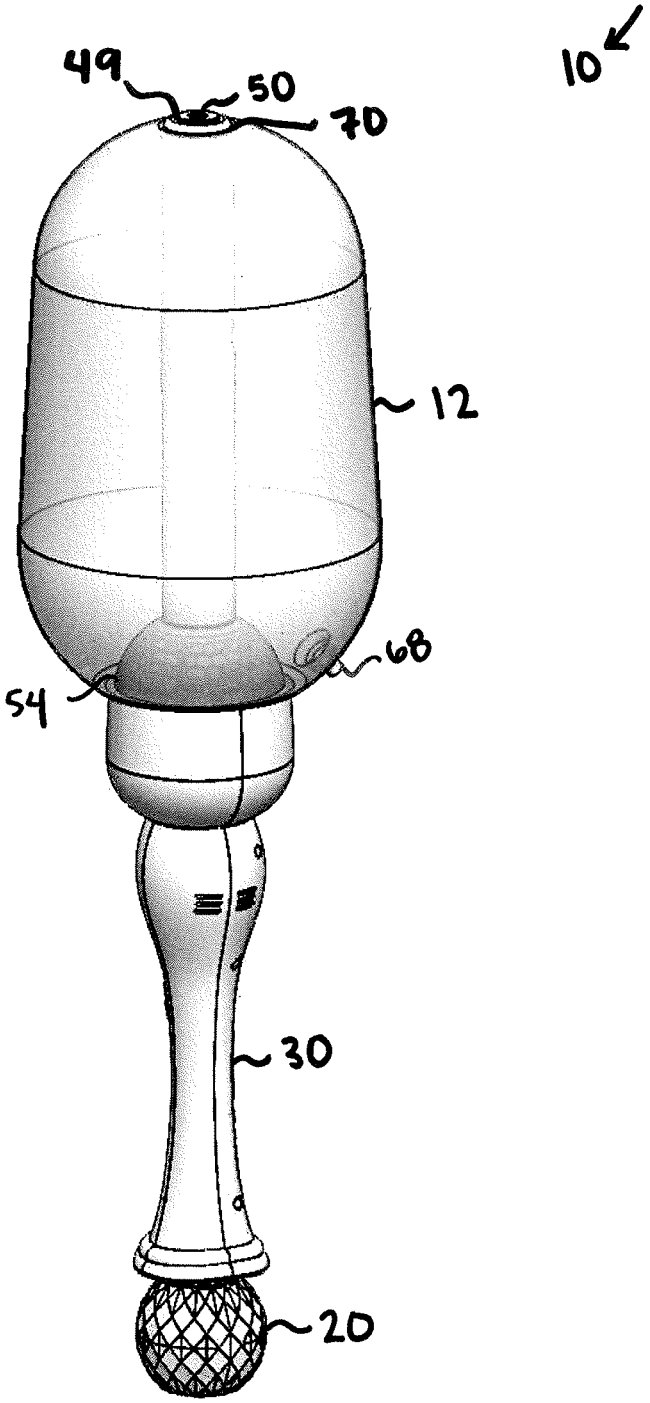
FIG. 1 is a front view of one embodiment of an illuminating bubble producing toy with an inflatable balloon attached thereto and prismatic light reflector.

FIGS. 1-5 illustrate various views of an illuminating bubble producing toy 10 with different embodiments of an attachable inflatable balloon 12, 13, 15 and light reflector 54, 59.

As shown in FIGS. 1-2 and 4-5, the toy 10 includes a bubble producing solution reservoir 20, which contains liquid, such as bubble solution. When this bubble solution is pumped through the toy, bubbles are produced out of an orifice 50 located in a top portion of the toy. The bubble solution is preferably non-toxic and non-slippery when the bubbles fall to the ground. The reservoir preferably has a flat bottom, so the toy can be positioned on a surface. The reservoir varies in size depending on the overall size of the toy. The reservoir is easily removed from the housing 30, so a user can easily refill the bubble solution, which increases the longevity of the toy.

Figure 2:
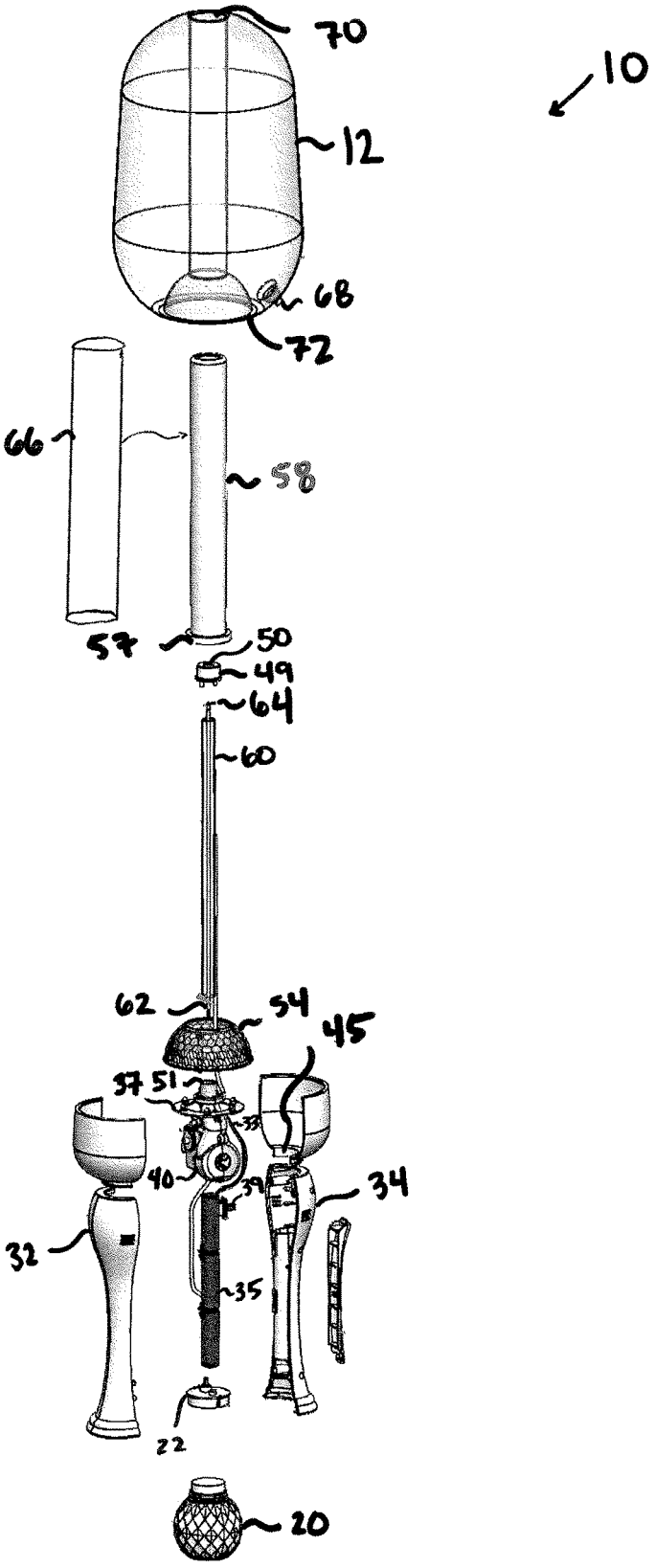
FIG. 2 is a partially exploded view of the illuminating bubble producing toy of FIG. 1 with the attachable inflatable balloon and the prismatic light reflector.
Figure 3:
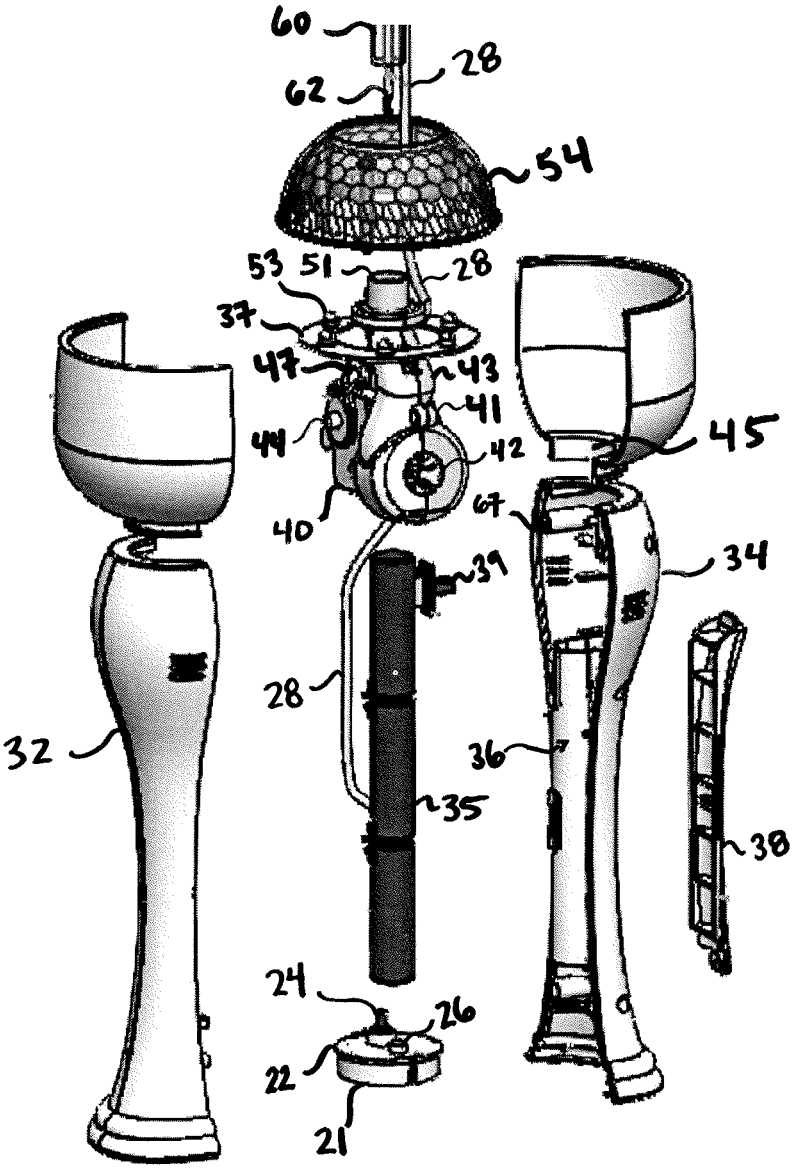
FIG. 3 is an exploded view of the housing of the illuminating bubble producing toy of FIG. 1.
Figure 4:
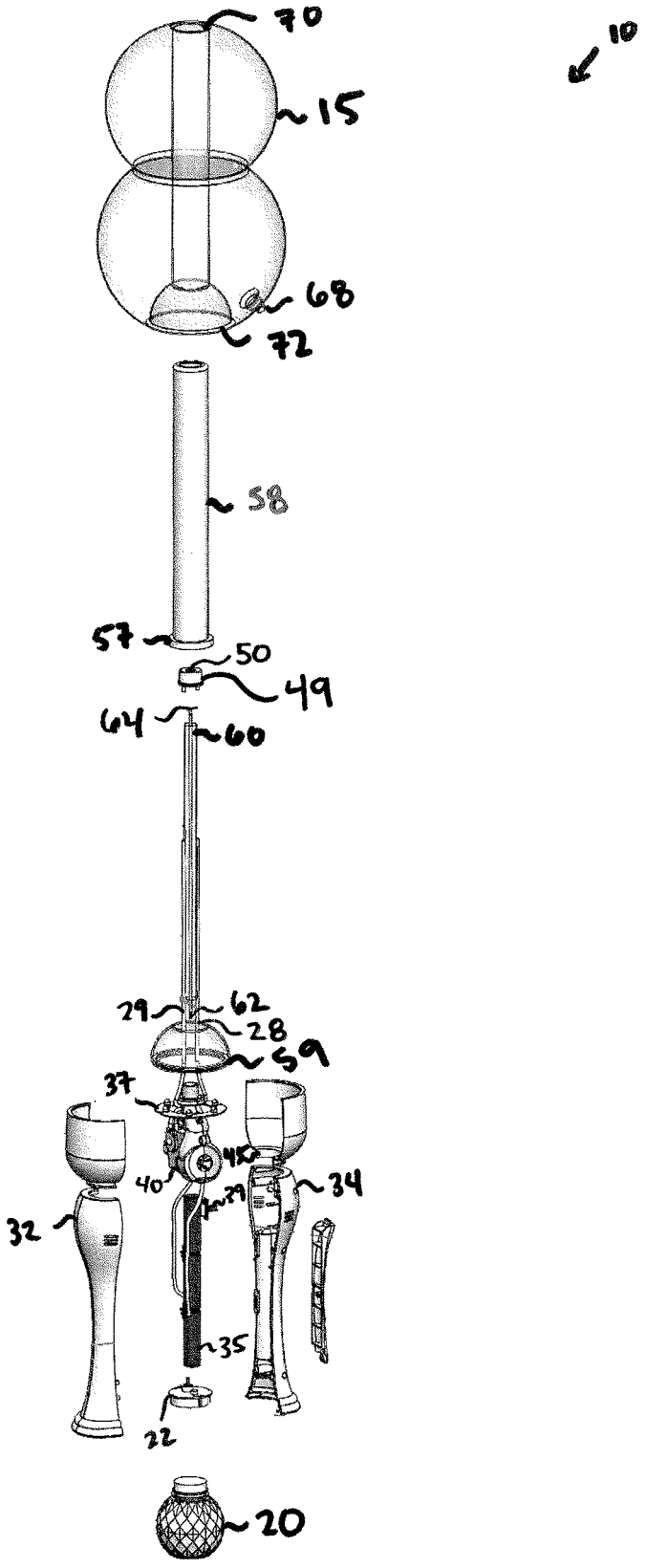
FIG. 4 is a partially exploded view of a second embodiment of an illuminating bubble producing toy with an attachable inflatable balloon and a light reflector.

As shown in FIGS. 2-4, most particularly FIG. 3, the reservoir 20 includes a cover 22, that connects to a top portion thereof and prevents solution from spilling out of the reservoir and into the other portions of the toy 10. One way in which the cover connects to the reservoir is via sides 21 that protrude downward from the cover and secure within the reservoir or around the reservoir, for instance via friction-fitting or clasps. The cover includes an opening 24 for the connection of a bubble solution supply channel 28 through which the solution submerged within the reservoir is pumped through the toy to a nozzle 49. The channel includes a tubular structure and is snug fit into the opening or around a converter secured within the opening so that one end of the channel is submerged within the solution in the reservoir. The cover of the reservoir also includes an opening 26 for the connection of a bubble solution recirculation channel 29, which channel also includes a tubular structure. The recirculation channel runs through the toy with one end connected to a nozzle in a top portion of the toy and the other end connected to the reservoir. Excess bubble solution that gathers in the nozzle is pumped or drained therefrom back to the reservoir for reuse. Advantageously, excess solution is recycled throughout the toy and does not leak into the housing where the electronics of the toy are stored. The portion of the recirculation channel the connects to the reservoir includes a ball valve or ball bearing (not shown), so that if a user turns the toy upside down, liquid is prevented from leaking out of the reservoir and into the housing.

As shown in FIGS. 1-2 and 4, the reservoir 20 is connected to the housing 30 by twisting or screwing the reservoir into the housing. The housing is enclosed and is designed in a handle shape for the user to comfortably hold the toy 10. The housing is preferably made of a lightweight, but durable, material such as plastic that can withstand being dropped without breaking. The housing is hollow and can be made of one monolithic piece or may consist of a front 32 and back cover 34 secured together, for instance via screws. The housing includes a power source for operation of the toy, which includes batteries 35 which are secured within a battery compartment 36, which, as shown in FIGS. 2-4, is located within the back cover of the housing. The battery compartment includes a casing 38 that secures the batteries within the compartment, for instance via screws. The batteries are electrically connected to a button or switch 39 that is pressed by a user to power on the toy and control various functions of the toy. The battery compartment includes a fuse that protects the power source from overheating by cutting the power source if the temperature rises above safety requirements. The button is multi-functional and control multiple settings of various electronic operations of the toy. For example, the toy includes an LED module, which includes various LEDs 53 that are electrically connected to control circuity 37, which LEDs vary in color, luminosity, and intensity. In one manner of operation, when a user pushes the switch once, it illuminates all the LEDs. If a user pushes the switch again, the LEDs flicker. If the user pushes the switch again, the LEDs change color. These functions are not meant to be exhaustive. Furthermore, the switch controls other functions of the toy, such as the speed at which the bubbles are produced.

As shown in FIGS. 2-4, the toy 10 includes circuitry or control circuitry 37, such as a printed circuit board, that controls the various operations of the toy. The printed circuit board is electrically connected via wiring 33 to the battery 39, which is electrically connected to the button and is further electrically connected to the various LEDs 53. The printed circuit board is preprogrammed so each push of the button 39 produces a different effect within the toy. For instance, one push of the button activates the bubble producing feature and an LED light show. A second push only activates the LED light show while a third push produces a different light show effect. In another embodiment, the button is replaced with or used in addition to a software or signal-controlled switch that is controlled by an internal controller and circuitry of the toy and which can be communicatively activated by a remote device. The switch or other circuitry can also incorporate activation through embedded instructions and or receipt of activation signals received by a receiver and included electronics and circuitry. For example, the toy can include a receiver for receiving signals which activates the illumination or bubble producing features of the toy. The switch or other circuit can further incorporate proximity detection devices, such as, for example, RFID or other types of electronics, which sense location, proximity or other wireless operations which provide instructions for or instruct illumination or other various functions of the device. Such devices include instructions and circuitry operable to detect location in respect to a transmitted beacon.

For example, the toy 10 may automatically activate upon nearing a display, feature, attraction, or other location within an amusement park which is transmitting a unique beacon which, when received by the toy, causes the toy to illuminate or produce bubbles in a predetermined manner. Other possible automated instructions include emitting colors, playing predefined audio stored in memory of the toy or received by the receiver of the toy, playing signals which are streamed and received by the integrated receiver, and similar functionality.

In one embodiment, the toy 10 includes a sender that transmits a signal to a display, feature, attraction of other location within an amusement park. Accordingly, when a user with the toy nears a display, feature, attraction, or other location which can receive a unique beacon being sent from the toy, the display, feature, attraction etc. illuminates in a predetermined manner.

As shown in FIG. 2, the housing 30 includes wiring 33 that electrically connects the power source to the other electrical components of the toy 10, most of which are secured within the housing. As shown in FIGS. 2-4, a bubble engine 40 is secured to an inner surface of the housing, for instance when the front cover 32 and back cover 34 are secured together. FIG. 3 is a zoomed in view of the open housing and inner components thereof shown, which are also shown in FIGS. 2 and 4. It is understood that FIGS. 2 and 4 include the components shown in FIG. 3, even if not labeled. The bubble engine contains the structural components necessary for pumping bubble solution from the reservoir 20 and through the discharge orifice 50. The bubble engine is like the bubble engine found in the bubble producing wand, which is made by Applicant and is disclosed in U.S. patent application Ser. No. 17/335,447, which application is incorporated by reference herein in its entirety. As shown in FIG. 3, the bubble engine includes an enclosed shell 41 that is water resistant or waterproof and advantageously aids in protecting the electrical components from being damaged by leaking bubble solution. The shell is made of plastic and is secured via screws to various pegs 67, which prevents the shell from shifting within the housing.

As shown in FIGS. 2-3, the shell 41 includes a front cover and a back cover, which are secured together, for instance via screws. The shell may also be manufactured to be one piece. The shell is configured in a predetermined shape so that, when the front and back covers are secured together, the various components within the shell are secured in place. The shell is configured to contain a motor 44 that is electrically connected to a pump 47, which is connected to a gearbox (not shown) and an air producing device 42. The motor can be any type of motor that most effectively produces the amount of energy needed to create the precise number of rotations necessary to generate the desired quantity of bubbles. Advantageously, the rotational speed of the motor is reduced to a specific rpm so that there is less solution on the nozzle 49 of the device 10, which avoids solution overflow into the device. Further, this motor also generates the necessary airflow rate to create the desired quantity of bubbles. Further, the toy advantageously uses less electric current because of the slowed speed of the motor, therefore increasing battery life of the toy. The motor is connected on one end to the air producing device and on an opposite end to a worm gear (not shown) that drives both the pump and the wiper 64.

To further aid in producing the desired size and quantity of bubbles is the type of pump 47 used, which is preferably a peristaltic pump. This pump is connected to the gearbox (not shown), which includes a plurality of gears for controlling the speed of the pump to produce the correct number of bubbles per minute. The pump operates in combination with the gearbox, which draws the bubble solution from the reservoir 20 through the channel 28. The channel extends from the reservoir, through the housing 30, via the pump and the gearbox. A specific number of gears are utilized to control the rate at which the solution is pumped from the reservoir and through the channel. The channel further extends upwardly through the outer tube 58 and connects on a second end to the nozzle 49.

The motor 44 is also electrically connected to the air producing device 42. The air producing device can be any device that produces an airstream with the velocity needed to project the solution through the discharge orifice 50 of the nozzle 49, such as a fan. The air duct 43 is a hollow tube that is secured to, part of or formed by the shell 41. The air duct is bent at an angle to aid in creating in the precise number of bubbles to not overheat the toy. Secured to a top portion of the air duct is an air discharge orifice 51, through which air is pushed. Secured inside this air discharge orifice is a drive shaft 62, which is connected on a bottom end to the motor via a crown gear. On a second end of this driveshaft is a wiper 64, which rotates via the motor. The solution channel 28 connects to the nozzle so bubble producing solution drips into a trough (not shown) in the nozzle. This nozzle is like that found in the bubble producing wand, which is made by Applicant and is disclosed in U.S. patent application Ser. No. 17/335,447, which application is incorporated by reference herein in its entirety. The three-hundred-and-sixty-degree rotation of the wiper around the trough forms a film, which film creates bubbles when air is pushed upwardly from the air producing device through the bubble discharge orifice.

As shown in FIGS. 2-4, the drive shaft 62 is secured within an inner tube 60. This inner tube aids in protecting the driveshaft and allowing its rotation without interfering with the solution channel 28 and the recirculation channel 29. The inner tube is preferably made of clear plastic so that light can be reflected therethrough. The inner tube is friction fitted to secure around the outside of the air discharge orifice 51. As shown in FIG. 4, secured to the outside of the inner tube is the recirculation channel 29 and the solution channel 28, which ultimately connect to nozzle 49 for both supplying bubble producing solution and recirculating excess bubble producing solution back to the reservoir 20. These channels may be secured by any conventional means, such as glue or may secure into notches that are on the outside of the tube. Secured around the outside of the inner tube and the solution channels is an outer tube 58 that is preferably made of PVC and includes a reflective sleeve 66 that coats an inside surface of the tube. This outer tube further protects the recirculation channel and solution channel and aids in preventing solution from leaking into the rest of the toy. The outer tube is secured to a top portion of the housing 30. As shown in FIGS. 2-4, when connected, the top portion of the front 32 and back cover 34 of the housing form a shelf 45. A base 57 of the outer tube securely fits into this shelf and may be further secured for instance via screws. Secured to a top portion of the outer tube is the nozzle.

As shown in FIGS. 2-4, secured around a top portion of the base 57 of the outer tube 58 is an LED module which includes the printed circuit board 37 with various LEDs 53 that are electrically connected thereto. The LEDs are secured atop the printed circuit board, for instance via glue, and face upwards to project light upwards through the top portion of the toy 10. The LED module is preferably circular with a hollow center through which the outer tube 58 runs. There can be any number of LEDs present. The configuration of the LEDs works in combination with the light reflectors 54, 59 to project light through the outer tube and the balloon 12.

As shown in FIGS. 1-4, further secured around the base 57 of the outer tube 58 and the entirety of the LED module 52 is the light reflector 54, 59. This light reflector secures into the shelf 45 of the front 32 and back cover 34 of the housing when they are connected. The light reflector is a clear plastic and preferably includes a prismatic pattern, as shown in FIGS. 1-3 that advantageously splits the light from the LEDs and reflects said light into the inflatable balloon 12 and the outer tube in various directions and patterns. Moreover, the reflective sleeve 66 secured around the inner surface of the outer tube further reflects the light in a unique pattern. As shown in FIG. 4, another embodiment of the reflector does not include a prismatic pattern. The light reflector can have any shape, design, images, etc. to reflect the light into interesting and unique ways into the balloon and the outer tube.

Figure 5:
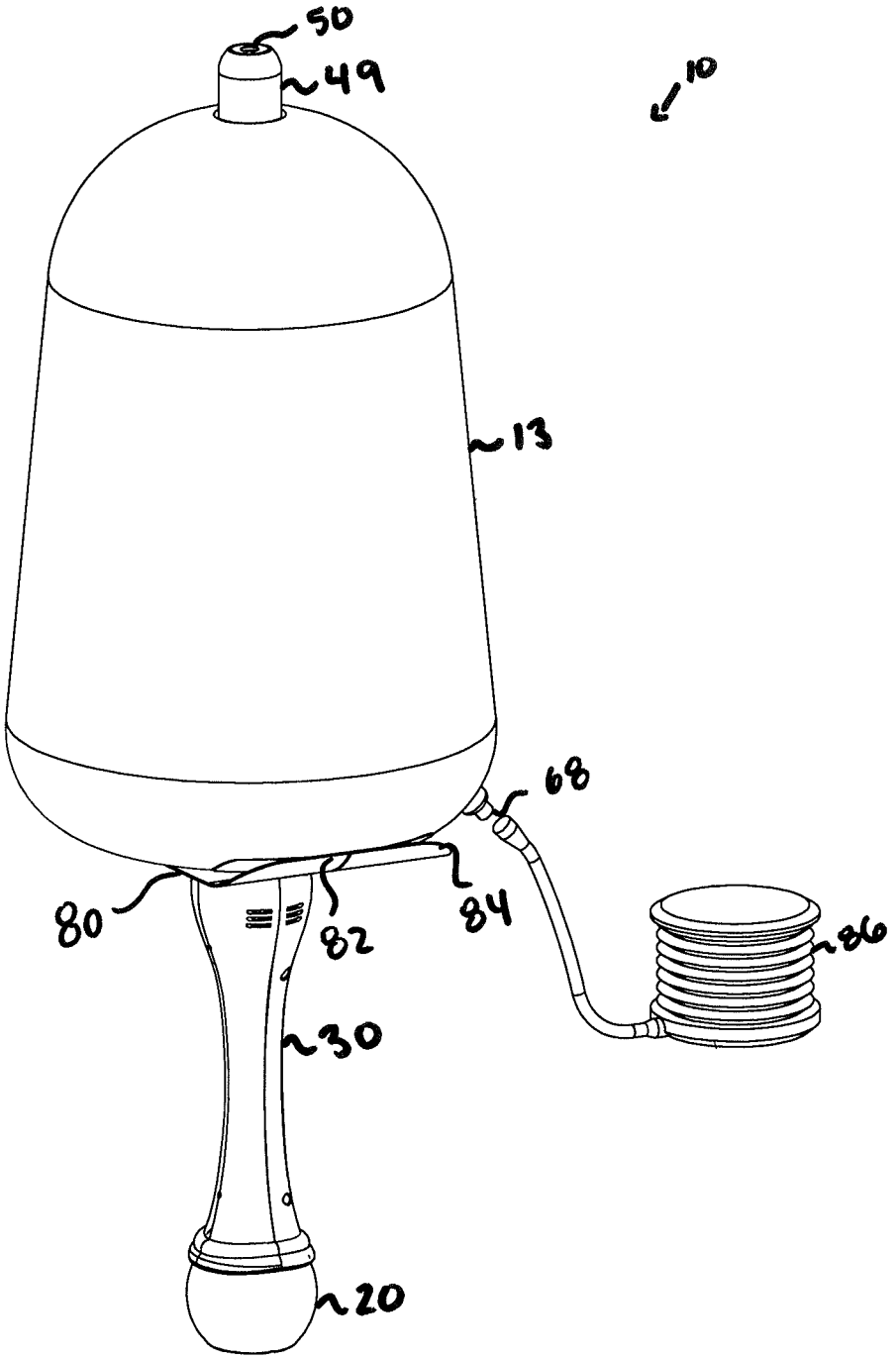
FIG. 5 is a side view of a third embodiment of an illuminating bubble producing toy with an attached inflatable balloon.

As shown throughout FIGS. 1-2 and 4-5, the inflatable balloon 12 varies in shape. For instance, FIG. 4 shows the balloon 15 having two layered spheres. The embodiment of the balloon 13 in FIG. 5 varies slightly from the shape of the balloon in FIGS. 1-2. Advantageously, the balloon in all these embodiments is easily removeable from the toy 10. As shown in FIGS. 1 and 3-4, the inflatable balloon includes a hollow shaft 70 and a domed inlet 72. Accordingly, a user slides the balloon onto the outer tube 58 and the balloon friction fits at the bottom around the light reflector 54, 59 and around the outer tube. For example, in FIG. 1 balloon is friction fitted onto the outer tube when inflated. FIG. 5 shows a flap 80 that is secured to or part of a lower edge of the balloon. This flap aids in further securing the balloon around the outer tube. The flap includes two wings 82, 84, which separately wrap around the outer surface of the housing. The wings include tape, such as magic tape, which secures to the housing. The balloon can be any shape or size or any character depending on user preference. The balloon is preferably made of a plastic material that is capable of being inflated and deflated. The balloon can be any opacity but is preferable of a white opacity so that the images and patterns reflected thereon from the light reflecting through the light reflector 54 are most easily viewed by the user. As shown in FIGS. 1-2 and 4-5, all embodiments of the balloon include a nozzle 68 whereby the user can manually blow up and deflate the balloon. As shown in FIG. 5, the balloon may also be inflated and deflated electrically or with a hand pump 86.

As shown in FIG. 1, when the LEDs 53 shine light through the light reflector 54, the light reflector splits the light from the LEDs into many different light patterns. These patterns are then reflected onto the inner surface of the inflatable balloon. For example, if the control circuitry 37 times the LEDs to illuminate at different times, then the light shining through the light reflector and into the balloon may have the appearance of a moving animation. Moreover, the reflective sleeve 66 secured on the inside surface of the outer tube 58 further refracts the light into a unique pattern that is viewable to a user. The light is preferably refracted onto an inside surface of the balloon but is not projected outside the inside surface of the balloon.

When the toy 10 is in use, a user will press the button 39, which activates the electrical components of the toy, i.e., the components of the bubble engine 52 are activated and solution is pumped from the solution reservoir 20 through the solution channel 28 to the nozzle 49. Simultaneously, air is pushed from the air producing device 42 through the air discharge orifice 51 and upwardly through the inner tube 60. The air then pushes the bubbles out the top of the toy at the bubble discharge orifice 50. When the switch of the toy is pressed, printed circuit board 37 is activated, which illuminates the LEDs 53. Accordingly, the LEDs are illuminated and begin reflecting light upwardly through the light reflector 54. Depending on the illumination and timing of the LEDs, various patterns and animations are created from the light shining through the prismatic face of the reflector. The light projections reflect through the domed inlet 72 of the inflatable balloon 12, 13, 15 and onto the inner surface of the balloon. These light patterns are visible to the user through the balloon.

It is well recognized by persons skilled in the art that alternative embodiments to those disclosed herein, which are foreseeable alternatives, are also covered by this disclosure. The foregoing disclosure is not intended to be construed to limit the embodiments or otherwise to exclude such other embodiments, adaptations, variations, modifications and equivalent arrangements.

The invention claimed is:

1. An illuminating bubble producing toy with an attachable inflatable balloon comprising:

a housing having a first and second end, wherein the housing contains a motor, a pump, and an air producing device attached to an air duct;

a bubble producing solution reservoir connectable to the first end of the housing;

a hollow shaft having a first and second end, wherein the first end is connected to the second end of the housing, wherein the inflatable balloon is attachable around the hollow shaft;

a drive shaft fixed within the hollow shaft and connected to the motor;

a nozzle secured within the second end of the hollow shaft;

a wiper secured to the drive shaft, wherein the wiper rotates around an inside of the nozzle;

a printed circuit board secured around the first end of the hollow shaft, wherein the printed circuit board includes a receiver;

LEDs secured and electrically connected to the printed circuit board;

a prismatic reflector secured around the LEDs; and a channel comprising a tubular structure with two ends, wherein a first end is submerged within the solution reservoir and a second end is connected to the nozzle.

2. The illuminating bubble producing toy of claim 1, wherein the inflatable balloon contains an inflation and deflation valve.

3. The illuminating bubble producing toy of claim 1, wherein the inflatable balloon further comprises a flap secured to a bottom surface of the balloon, wherein the flap is attachable around the housing.

4. The illuminating bubble producing toy of claim 1, wherein an inner surface of the hollow shaft is a reflective sleeve.

5. The illuminating bubble producing toy of claim 1 further comprising a recirculation channel comprising a tubular structure with two ends, wherein a first end is connected to the nozzle and a second end is connected to the reservoir.

6. An illuminating bubble producing toy with an attachable inflatable balloon comprising:

a housing having a first and second end, wherein the housing contains a motor, a pump, and an air producing device attached to an air duct;

a bubble producing solution reservoir connectable to the first end of the housing;

a hollow shaft having a first and second end, wherein the first end is connected to the second end of the housing, wherein the inflatable balloon is attachable around the hollow shaft;

a drive shaft fixed within the hollow shaft and connected to the motor;

a nozzle secured within the second end of the hollow shaft;

a wiper secured to the drive shaft, wherein the wiper rotates around an inside of the nozzle;

a printed circuit board secured around the first end of the hollow shaft;

LEDs secured and electrically connected to the printed circuit board;

a prismatic reflector secured around the LEDs; and a channel comprising a tubular structure with two ends, wherein a first end is submerged within the solution reservoir and a second end is connected to the nozzle.

7. The illuminating bubble producing toy of claim 6, wherein the inflatable balloon contains an inflation and deflation valve.

8. The illuminating bubble producing toy of claim 6, wherein the inflatable balloon further comprises a flap secured to a bottom surface of the balloon, wherein the flap is attachable around the housing.

9. The illuminating bubble producing toy of claim 6, wherein an inner surface of the hollow shaft is a reflective sleeve.

10. The illuminating bubble producing toy of claim 6 further comprising a recirculation channel comprising a tubular structure with two ends, wherein a first end is connected to the nozzle and a second end is connected to the reservoir.

11. The illuminating bubble producing toy of claim 6, wherein the prismatic reflector is dome shaped.

12. The illuminating bubble producing toy of claim 6, wherein the LEDs reflect through the prismatic reflector into the hollow shaft and the balloon.

13. The illuminating bubble producing toy of claim 6, wherein the printed circuit board is preprogrammed to control the illumination of the LEDs and the rate of bubble production.

14. An illuminating bubble producing toy with an attachable inflatable balloon comprising:

a housing having a first and second end, wherein the housing contains a motor, a pump, and an air producing device attached to an air duct;

a bubble producing solution reservoir connectable to the first end of the housing;

a hollow shaft having a first and second end, wherein the first end is connected to the second end of the housing;

a drive shaft fixed within the hollow shaft and connected to the motor;

a nozzle secured within the second end of the hollow shaft;

a wiper secured to the drive shaft, wherein the wiper rotates around an inside of the nozzle;

a printed circuit board secured around the first end of the hollow shaft;

LEDs secured and electrically connected to the printed circuit board;

a dome shaped prismatic reflector secured around the LEDs; and a channel comprising a tubular structure with two ends, wherein a first end is submerged within the solution reservoir and a second end is connected to the nozzle;

wherein the inflatable balloon comprises a corresponding hollow sleeve with a dome shaped base for attachment around the hollow shaft and the dome shaped prismatic reflector.

15. The illuminating bubble producing toy of claim 14, wherein the inflatable balloon contains an inflation and deflation valve.

16. The illuminating bubble producing toy of claim 14, wherein the inflatable balloon further comprises a flap secured to a bottom surface of the balloon, wherein the flap is attachable around the housing.

17. The illuminating bubble producing toy of claim 14, wherein an inner surface of the hollow shaft is a reflective sleeve.

18. The illuminating bubble producing toy of claim 14 further comprising a recirculation channel comprising a tubular structure with two ends, wherein a first end is connected to the nozzle and a second end is connected to the reservoir.

19. The illuminating bubble producing toy of claim 14, wherein the LEDs reflect through the prismatic reflector into the hollow shaft and the balloon.

20. The illuminating bubble producing toy of claim 14, wherein the printed circuit board is preprogrammed to control the illumination of the LEDs and the rate of bubble production.

* * * * *